United States Patent [19]

Nelson

[11] Patent Number: 4,945,665

[45] Date of Patent: Aug. 7, 1990

[54] QUICK-RELEASE GUN TRIGGER SAFETY DEVICE

[76] Inventor: Stephen G. Nelson, 469 Canton Dr., Solana Beach, Calif. 92075

[21] Appl. No.: 455,172

[22] Filed: Dec. 22, 1989

[51] Int. Cl.[5] ..... F41A 17/54

[52] U.S. Cl. ..... 42/70.07; 42/70.11

[58] Field of Search ..... 42/70.07, 70.11

[56] References Cited

U.S. PATENT DOCUMENTS

| | | | |
|---|---|---|---|
| 2,080,202 | 5/1937 | Drake | 42/1 |
| 2,195,693 | 4/1940 | Clifton . | |
| 2,401,482 | 6/1946 | Hendey . | |
| 2,590,516 | 3/1952 | De Von Breymann . | |
| 3,022,596 | 2/1962 | Cannon | 42/1 |
| 3,713,239 | 1/1973 | Sperling | 42/1 |
| 3,732,641 | 5/1973 | Adajian . | |
| 4,723,370 | 2/1988 | Sheehan | 42/70.07 |
| 4,825,576 | 5/1989 | Troncoso et al. | 42/70.07 |

*Primary Examiner*—Charles T. Jordan
*Assistant Examiner*—Richard W. Wendtland
*Attorney, Agent, or Firm*—Brown, Martin, Haller & McClain

[57] ABSTRACT

A block made of a resilient material is molded to conform to the inner perimeter of a gun trigger guard. The trigger is held in a depressed state when the block is inserted. The block has flexible flanges formed on both sides which partially extend around the trigger guard and the depressed trigger to hold the block in place.

At the approximate center, where the undepressed trigger would normally be, a simulated trigger is formed so as to appear to be part of the weapon. In front of the simulated trigger is an opening into which the trigger finger may be inserted in a normal manner, promoting the appearance of the block as being part of the weapon, disguising the fact that the weapon has been disabled.

8 Claims, 1 Drawing Sheet

QUICK-RELEASE GUN TRIGGER SAFETY DEVICE

FIELD OF THE INVENTION

The present invention relates to gun safety devices and more particularly to quick release safety devices for gun triggers.

BACKGROUND OF THE INVENTION

Several different safety devices are available or have been proposed to prevent inadvertent firing of guns. Some devices require modification of the gun itself. These trigger protectors consist of a cover of the entire trigger guard which prevents access to the trigger. The protective covers are attached to at least one portion of the trigger guard by pins or screws, holes for which must be drilled in the gun. Another version consists of at least two components which clamp over the trigger and trigger guard or consist of a relatively loose-fitting or easily removed rubber boot. This design does not lend itself to the frame/trigger guard configurations of semi-automatic handguns and is actually more of an accidental discharge/dust protector.

Other safety devices are molded plugs formed to the shape of the trigger guard and trigger or bolt assemblies which fit behind the trigger, holding it in an unfired position. Some of these devices are readily removed when firing is necessary, but many are too easily removed by an uninitiated person, such as a child. Others require detaching or loosening a fastener, which may be effective in preventing a child from firing the gun, but also hinder a proper user, requiring that more than mere pressure be applied to the device to release it. Such devices clearly work only with guns which have space behind the trigger, meaning that the trigger is held in a fire-ready position.

Any device which holds the trigger in an unfired position puts the weapon in a state where failure of the device or application of sufficient finger pressure to overcome the resistance of the material used, especially with a "behind the trigger plug", could result in the weapon firing. A device which holds the trigger in a depressed state has essentially deactivated the trigger, i.e., the trigger must return to an unfired position before the firing cycle can occur. Therefore, if the safety device fails, the trigger merely returns to the unfired position.

A third type of safety device is a locking clamp which holds the trigger in a depressed position, thus preventing the chamber from being in a loaded condition. This in turn avoids the possibility of firing the gun by pulling back and releasing the hammer. The primary disadvantage of this device is that the user must unlock it with a key if firing should become necessary. A delay in having access to the gun while searching for the key or trying to insert the key in the lock could have serious consequences for the gun's user in a life-threatening situation. When such a risk is involved, the user may instead be tempted to leave the device off if he anticipates a sudden need for the gun.

All of the above-mentioned devices possess the additional disadvantage that they are obvious, making it readily apparent that the gun has been disabled. A child who finds a gun protected by one of the prior art safety devices might, out of curiosity, tamper with the device to see if he can remove it, since it is obviously not part of the gun. Also, a person who threatens harm to a gun's proper user would not be deterred when confronted with a weapon which is obviously disabled. The user would be required to remove the device at the same time he was drawing the gun, possibly causing a delay in correctly aiming the gun. Any device which is difficult, complex or time-consuming to operate is essentially non-protective and counterproductive in a life threatening situation.

It would be desirable to have a trigger safety device which is capable of quick, ambidextrous release which holds the trigger in a depressed, unfirable condition but which disguises the fact that the gun is disabled and makes it appear that the gun is ready to fire. It is to this end that the present invention is directed.

BRIEF SUMMARY OF THE INVENTION

The invention comprises a block made of a resilient material which is molded to conform to the inner perimeter of a gun trigger guard. The trigger is held in a depressed state when the block is inserted. The block has flexible firm flanges formed on both sides which partially extend around the trigger guard and the depressed trigger to hold the block in place. The flanges bend as the block is inserted into the trigger guard and snap back into their original configuration when the block is properly seated. The block may be inserted or removed from either side of the gun, and will work on both handguns and rifles.

The front portion of the block conforms to the shape of the trigger guard. A flat diaphragm portion extends from the front toward the center of the trigger guard to provide both additional support and a surface which may be pushed with the thumb of either hand to remove or insert the block. At the approximate center, where the undepressed trigger would normally be, a simulated trigger is formed so as to appear to be part of the weapon. In front of the simulated trigger is an opening into which the trigger finger may be inserted in a normal manner, promoting the appearance that the block is part of the weapon. This feature also allows the disabled weapon to be held for practice sighting, familiarization and other normal handling procedures. By holding the gun with one hand, an adult with normal hand and finger strength can, by using the other hand and pressing the thumb on the flat diaphragm portion of the block, snap the block out of the trigger guard, rendering the weapon available for use.

In addition to normal familiarization, handling and sighting, this device is a safety device that allows the gun to be displayed on a conventional, vertical rack which uses a peg through the trigger guard, such as in a gun store. The gun could be examined by potential customers in the store with the device in place to eliminate any possibility of the weapon firing.

A quick-release trigger safety device for guns having a trigger guard comprises a resilient block formed to closely fit the inner perimeter of the trigger guard with the gun's trigger depressed. The block has a flange on each side extending beyond the inner perimeter of the trigger guard to hold the block in place. An opening is disposed at the center of the block which is sufficiently large to permit insertion of a user's trigger finger. A simulated trigger is formed at the edge of the opening closest to the gun's trigger.

DETAILED DESCRIPTION OF THE INVENTION

Figure 2A:
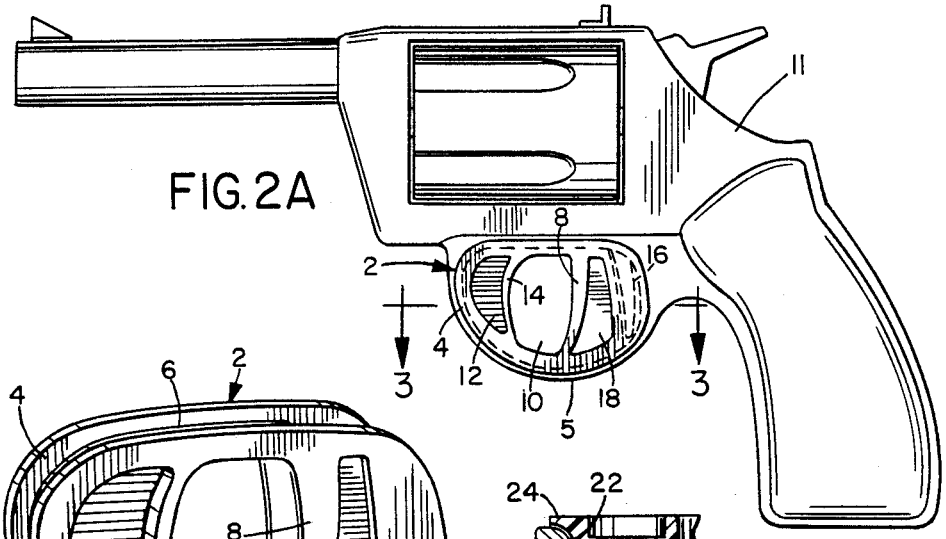
FIG. 2 is a side view of a gun with the trigger safety device of the present invention inserted in the trigger guard.
Figure 1:
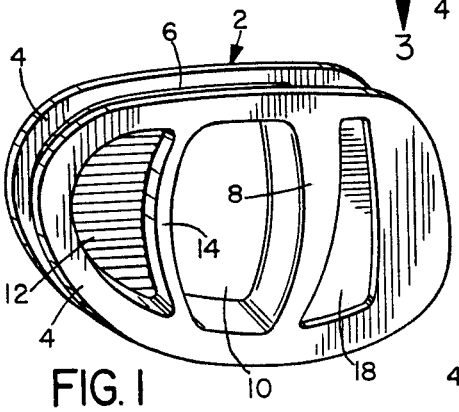
FIG. 1 is a perspective view of the gun trigger safety device.
Figure 3B:
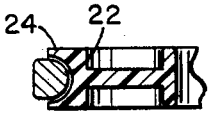
FIG. 3 is a sectional view taken on line 3—3 of FIG. 2.
Figure 3A:
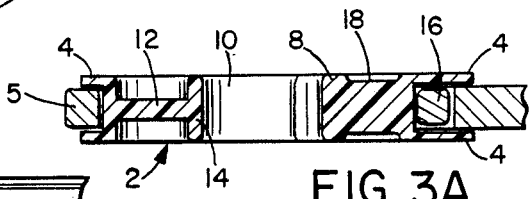
Figure 2B:
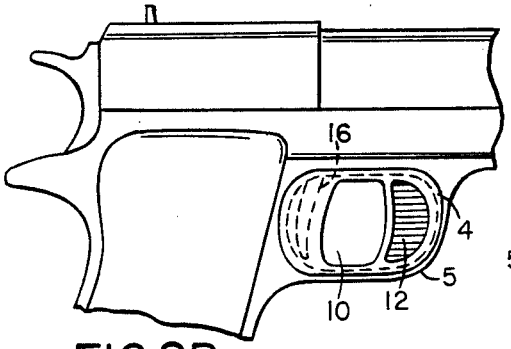

The quick-release trigger safety device 2 is shown in FIG. 1 and is formed from a flat block of resilient rubber or rubber-like plastic which is colored to match the weapon's color, e.g., black or dark gray. Flanges 4 are formed around the entire perimeter of the block partially enclosing edge 6. A thin, flat diaphragm 12 is disposed toward the front of the block, and a simulated trigger 8 is formed near the center behind a finger opening 10.

Figure 4:
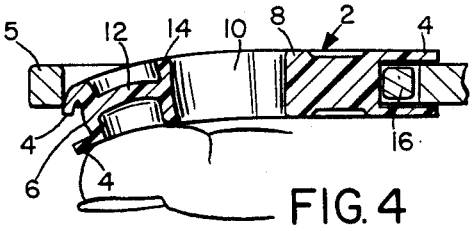
FIG. 4 is a perspective view showing removal of the trigger safety device.

Safety device 2 is shown inserted into the trigger guard 5 of gun 11 in FIGS. *2a, 2b* and *2c*, for a revolver, automatic pistol and rifle, respectively. Trigger 16 must be depressed with the gun unloaded in order to insert the safety device 2. Depending on from which side the safety device 2 is inserted, the flange 4 on the entering side of the safety device 2 will partially collapse, as shown in FIG. 4. The flange 4 on the non-entering side will halt the continued movement of the safety device 2 through the trigger guard 5, at which time the flange 4 on the entering side will snap back into its original configuration on the other side of the trigger guard, causing the safety device 2 to be seated in the trigger guard 5. A close fit around the trigger guard 5 is assured by making edge 6, which is perpendicular to and inset from flanges 4, approximately the same thickness as trigger guard 5.

In an alternate embodiment, for guns with trigger guards that have a convex radius around the inner perimeter, the trigger guard 5 has a radiused inner surface 22 instead of a squared configuration, as shown in FIG. *3b*. The flange 24 blends into the curvature and is, therefore, less obvious. The convex radius itself holds the trigger guard 5 in position.

Safety device 2 has a thin, flat diaphragm 12 spanning the space between edge 6 at the front of device 2 and support 14 at the forward center. Diaphragm 12 provides greater flexibility of the entire block for insertion and removal, and serves as a pressure point where the gun's user may use the thumb of either hand to press and remove the safety device 2. For removal, sufficient pressure on diaphragm 12 causes flange 4 on the same side that pressure is being applied to partially collapse, allowing flange 4 to pass through the trigger guard 5, disengaging the safety device 2. The diaphragm 12 is textured or has ridges on both sides to provide friction for better contact with the user's thumb. It would be preferred that the block and the diaphragm 12 be of sufficient rigidity to require that the force to remove the device 2 be that of a normal adult's hand strength.

Figure 5:
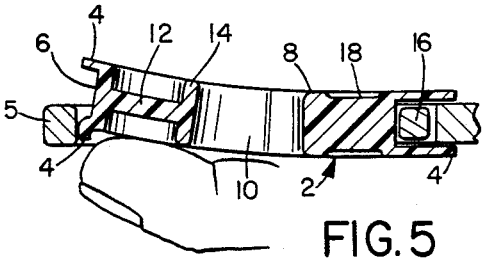
FIG. 5 is a perspective view showing an alternate means of removal of the trigger safety device.
Figure 2C:
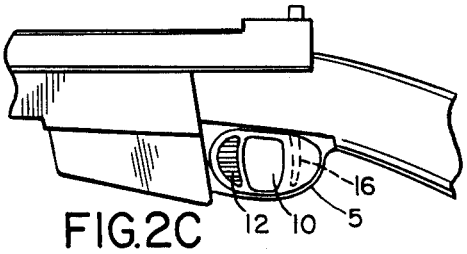

Opening 10 in the center of the block is sufficiently large for easy insertion of the trigger finger for practice sighting or for getting the "feel" of the gun. It also facilitates removal of safety device 2 by collapsing the block into the opening and pulling the edge 6 away from the trigger guard 5, as shown in FIG. 5. The opening 10 must also be large enough to give the appearance, particularly to a person unskilled in the use of weapons, that the gun is not disabled by a safety device and is ready to fire. Such an appearance is intended to discourage tampering with the safety device 2 by a curious child who might find the gun. The child can handle the gun and even pretend to fire it without posing a risk of discharging the weapon. An additional purpose is to make the gun appear to be fire-ready when it is quickly removed from a holster or concealed location during an emergency. If firing should become necessary, the safety device 2 can be readily removed by pressing the diaphragm 12 with the thumb of one hand. The gun can safely be stored with the device 2 at all times; given the quick-release, ambidextrous nature of the device, the user would not be tempted to leave off the safety device 2 if he anticipates a future need to draw the weapon.

The appearance of being "fire-ready" is further enhanced by molding the rear boundary of opening 10 to look like a trigger. Simulated trigger 8 is located approximately where the gun's trigger 16 would be in its undepressed state. The simulated trigger 8 also allows the gun 11 to be held in a normal manner for practice sighting without presenting the danger of accidental discharge. This permits "getting the feel" of the weapon, and if the gun falls into a child's hands, safely deals with the common response of aiming the gun and trying to pull the trigger.

The portion of the block behind simulated trigger 8 is solid and may be slightly thinner than the simulated trigger 8 to give the appearance that it is an extension of the trigger, such as a plunger. Simulated plunger 18 provides a solid block which maintains the trigger 16 in a depressed state. Flanges 4 enclose the trigger 16 and extend beyond the inner perimeter of the trigger guard 5 so that trigger 16 is completely concealed.

FIG. *3a* illustrates a possible configuration of relative thicknesses across the block which enhance the block's appearance of being part of the gun 11. The safety device of the present invention provides a preventative for inadvertent firing of any type of gun which has a trigger guard. The device is formed of an inexpensive material and is colored to blend into the weapon so that it is not readily apparent to an uninitiated person that the gun is disabled. The device is reusable and may be inserted and removed from either side of the gun, making it practical for ambidextrous use.

It will be evident that there are additional embodiments which are not illustrated above but which are clearly within the scope and spirit of the present invention. The above description and drawings are therefore intended to be exemplary only and the scope of the invention is to be limited solely by the appended claims.

I claim:

1. A quick release trigger safety device for a gun having a trigger guard with an inner perimeter comprising:

a resilient block formed to closely fit said inner perimeter of said trigger guard with the gun's trigger depressed having a flange on each of two sides of said block extending beyond said inner perimeter to hold said block in place, an opening having front and rear edges disposed at the center of said block, said opening being sufficiently large to permit insertion of a user's trigger finger, and a simulated trigger formed at the rear edge of said opening.

2. A quick-release trigger safety device as in claim 1 wherein said resilient block comprises two broad flat surfaces and a narrow surface having a thickness approximately equal to the thickness of said trigger guard perpendicular to said broad flat surfaces, said flanges extending beyond both sides of said narrow surface.

3. A quick-release trigger safety device as in claim 1 wherein a flat diaphragm is disposed in a portion of said broad flat surfaces between said simulated trigger and the front of said block so that the block will partially collapse for insertion or removal.

4. A quick-release trigger safety device as in claim 1 wherein said resilient block comprises a resilient rubber-like material colored to match the color of said gun.

5. A quick-release trigger safety device as in claim 1 wherein said flange collapses when pressed against said trigger guard upon attempted insertion of said block and resides to said flange's original configuration when said block is fully seated within said trigger guard.

6. A quick-release trigger safety device as in claim 1 wherein said flange collapses when pressed against said trigger guard using sufficient pressure upon attempted removal of said block and resides to said flange's original configuration when said block is fully removed.

7. A quick-release trigger safety device as in claim 1 wherein said simulated trigger is formed at the approximate location where said trigger would be in an undepressed state.

8. A quick-release trigger safety device as in claim 3 wherein ridges are disposed on said flat diaphragm to provide a friction surface for the user's thumb.

* * * * *